US005457266A

United States Patent [19]

Bege et al.

[11] Patent Number: 5,457,266

[45] Date of Patent: Oct. 10, 1995

[54] PROCESS FOR TREATING RADIOACTIVE WASTE

[75] Inventors: Dietmar Bege, Erlangen; Karl-Heinz Kleinschroth; Robert Grigat, both of Frankfurt, all of Germany

[73] Assignee: Siemens Aktiengesellschaft, Munich, Germany

[21] Appl. No.: 245,764

[22] Filed: May 18, 1994

Related U.S. Application Data

[63] Continuation of PCT/DE92/00925, Nov. 6, 1992

[30] Foreign Application Priority Data

Nov. 18, 1991 [DE] Germany ..... 41 37 947.0

[51] Int. Cl.[6] ..... G21F 9/00

[52] U.S. Cl. ..... 558/20; 588/3; 588/4; 588/5; 588/19; 976/DIG. 381; 976/DIG. 385

[58] Field of Search ..... 588/20, 3, 4, 5, 588/19; 976/DIG. 381, DIG. 385

[56] References Cited

U.S. PATENT DOCUMENTS

| | | | |
|---|---|---|---|
| 4,008,171 | 2/1977 | Tiepel et al. | 588/20 |
| 4,053,432 | 10/1977 | Tiepel et al. | 588/19 |
| 4,204,974 | 5/1980 | Puthawala et al. | 588/5 |
| 4,636,335 | 1/1987 | Kawamura et al. | 588/11 |
| 4,671,897 | 6/1987 | Mori et al. | 588/3 |
| 4,732,705 | 3/1988 | Laske et al. | 588/3 |
| 4,741,866 | 5/1988 | Grantham et al. | 588/1 |
| 4,762,647 | 8/1988 | Smeltzer et al. | 588/20 |

FOREIGN PATENT DOCUMENTS 8500922 2/1985 WIPO .

OTHER PUBLICATIONS

Derwent Abstract AN 86–158976 of Published Japanese Application No. 61091600.

Derwent Abstract AN 89–180183 of Published European Application No. 321352.

*Primary Examiner*—Ngoclan Mai

*Attorney, Agent, or Firm*—Herbert L. Lerner; Laurence A. Greenberg

[57] ABSTRACT

A process for treating radioactive waste in the form of contaminated powdery ionic exchange resin to make it suitable for final storage by reducing its volume as much as possible, includes mechanically dewatering the ion exchange resin. The dewatered ion exchange resin is mixed with a calcium compound. The mixture is dried at temperatures of up to 120° C. and preferably about 50° C. to 60° C., and at a pressure of from 120 to 200 hPa, until a residual moisture content of less than 10% of the mass of the mixture is reached. The dry mixture is thermally treated at a pressure below atmospheric pressure by heating up to a temperature of from at least 120° C. to at most 190° C. The ion exchange resin thereby loses its water absorption and swelling capability. Ion exchange resins treated in this manner are processed with cement or bitumen to form blocks that are suitable for final storage.

7 Claims, No Drawings

PROCESS FOR TREATING RADIOACTIVE WASTE

CROSS-REFERENCE TO RELATED APPLICATION

This application is a Continuation of International Application Serial No. PCT/DE92/00925, filed Nov. 6, 1992.

BACKGROUND OF THE INVENTION

Field of the Invention

The invention relates to a process for treating radioactive waste which occurs in the form of contaminated, powdery ion exchange resin.

Such processes are used for reducing the volume of the quantity of waste. European Patent No. 0 126 060 B1 discloses processes used for that purpose in which a mixture of ion exchange resins is heated in the presence of water and a substance giving an alkaline reaction, until the onset of decomposition of the anion exchange resins and the release of amines. In that case, temperatures of up to 280° C. are required.

As tests have shown, the ion exchange resins in that case retain a significant part of their water absorption capability in spite of the not inconsiderable expenditure of energy for the heating. With regard to swelling processes associated with the water absorption, the proportion of ion exchange resins incorporated in a matrix, for example of cement or bitumen, must not exceed 10% of the mass of the waste product. That has the consequence of providing only an unsatisfactory reduction in the volume of the quantity of waste.

Derwent Abstract AN 86-158976 of Published Japanese Application 61 091 600 also already discloses a process for treating radioactive waste in the form of contaminated, powdery ion exchange resin, according to which the resin is dewatered, then mixed with a calcium compound and finally dried. That process also ensures only an unsatisfactory reduction in volume of the quantity of waste. The result is also not changed by adding drying to that process at temperatures of up to 120° C. according to Published International Application WO 85/00922.

SUMMARY OF THE INVENTION

It is accordingly an object of the invention to provide a process for treating radioactive waste, which overcomes the hereinafore-mentioned disadvantages of the heretofore-known methods of this general type and which treats ion exchange resins to be disposed of and put into final storage as waste, in such a way that their possible proportion of the weight and volume of a waste product is distinctly above 10%, with the aim of the treatment being to reduce water absorption and swelling capacities of the ion exchange resins.

With the foregoing and other objects in view there is provided, in accordance with the invention, a process for treating radioactive waste in the form of contaminated, powdery ion exchange resin, which comprises mechanically dewatering the ion exchange resin; mixing the dewatered ion exchange resin with a calcium compound to form a mixture; drying the mixture at temperatures of up to 120° C. and preferably around 50° C. to 60° C., and at a pressure of from 120 to 200 hPa, until a residual moisture content of less than 10% of the mass of the mixture is reached; and subsequently thermally treating the dry mixture at a pressure below atmospheric pressure by heating up to a temperature of from at least 120° C. to at most 190° C.

In accordance with another mode of the invention, there is provided a process in which after it has cooled, the thermally treated mixture is introduced into a matrix, preferably being formed of cement or bitumen, with the mass of the mixture amounting to up to 50% of the mass of the matrix.

In accordance with a further mode of the invention, there is provided a process in which calcium hydroxide is used as the calcium compound and its amount accounts for 50% to 150% of the take-up capacity of the ion exchange resins.

In accordance with an added mode of the invention, there is provided a process in which drawn-off vapors are passed on after their condensation, to a waste water treatment, in the same way as water occurring during the dewatering.

In accordance with a concomitant mode of the invention, there is provided a process in which at least the mixing, drying and thermal treatment of the ion exchange resin and the calcium compound take place in a mixing device which remains in operation at least until completion of the thermal treatment.

The process according to the invention is very advantageous, since it effects an irreversible elimination of the water absorption capability of the ion exchange resins in a surprising way, so that swelling of the ion exchange resins during or after their introduction into a matrix is prevented with certainty.

The behavior of the ion exchange resins subjected to the process according to the invention is surprising in as much as the calcium compound loads only the cations and in fact reduces only their water absorption and swelling behavior.

The simultaneous reduction in the water absorption and swelling behavior of the part of the ionic exchange resins representing anions makes it possible to harmlessly introduce at least twice as many resins into a matrix as would be possible without the treatment according to the invention.

As a result, the overall quantity of waste suitable for final storage from the ion exchange resins is noticeably reduced.

Other features which are considered as characteristic for the invention are set forth in the appended claims.

Although the invention is described herein as embodied in a process for treating radioactive waste, it is nevertheless not intended to be limited to the details given, since various modifications may be made therein without departing from the spirit of the invention and within the scope and range of equivalents of the claims.

The method of operation of the invention, however, together with additional objects and advantages thereof will be best understood from the following description of specific embodiments.

Referring now to the invention in detail, the process according to the invention is explained in more detail below with reference to an illustrative embodiment.

Depleted radioactively charged ion exchange resin is ground into a dusty powder and introduced, preferably as a suspension, into a drying apparatus, for example a cone drier. This suspension is initially mechanically dewatered in the cone drier. A calcium compound, for example calcium hydroxide in aqueous solution, is admixed with the dewatered, but still moist powder of ion exchange resin in a mixer. The amount of admixed calcium compounds in this case is sufficient to account for 50 to 150% of the take-up capacity of the ion exchange resin.

After thorough mixing of the ion exchange resin with the calcium hydroxide, the mixture thus formed is heated while the mixer continues to run. In this case, water present in the mixture is evaporated at a temperature of about 50° C. to 60° C. and at a pressure of 120 hPa to 200 hPa, until the residual moisture in the mixture is less than 10% of the mixture. This value is reached about 10 hours after beginning the drying operation.

Then, with the mixer still continuing to run, the temperature is increased to over 120° C., and preferably to 150° C. to 160° C., but at most to 190° C., for the thermal treatment of the mixture. In this case, at least the cations of the ion exchange resin which have previously not been loaded, enter into irreversible bonds with calcium hydroxide and lose their capacity for absorbing water.

The vapors produced during the drying and during thermal treatment are drawn off to obtain the subatmospheric pressure, are condensed and are passed on to a waste water treatment device, in the same way as the water occurring in the dewatering of the ion exchange resins.

Due to the heat treatment together with the preceding loading of the cation resins, the corresponding active groups are transformed in their water absorption capacity and swelling behavior to such an extent that virtually only the normal swelling behavior of plastic remains. As tests have shown, the water absorption capability and swelling capacity of the anion resin is also unexpectedly reduced at the same time by the thermal treatment.

However, the crucial step for the further reduction in swelling behavior and water absorption capacity is the virtually complete loading of the cation resins by the subsequent heat treatment. One heat treatment alone does not lead to the desired result with the cation resins in the temperature range.

By virtue of the absent water absorption capability and swelling capacity of the ion exchange resins following treatment, in comparison with untreated ion exchange resins, at least twice the amount can be incorporated in a matrix, with the mass of the treated mixture of the ion exchange resin and the calcium compound amounting to up to 50% of the mass of the matrix. Cement and bitumen are suitable in particular as the matrix. Since the ion exchange resin together with this matrix is suitable for final storage, use of the process according to the invention has the effect of reducing the quantity of the waste substance to be put into final storage to at least half. This is an advantage which is not to be underestimated for a managed and safeguarded final storage of radioactively contaminated ion exchange resins.

In order to leave the effectiveness of the process according to the invention unimpaired, it is expedient to permit the mixer or a mixing device to operate continuously without interruption during the mixing, drying and thermal treatment. This ensures that the mixture of the ion exchange resin and calcium compound achieves the same state of treatment in each case in all of the stages of the process in all of its regions.

The process according to the invention can be applied just as much to ion exchange resins as to toxic chemicals, provided that in each case they are in the form of mixtures of independently active mixture components including cations and anions.

We claim:

1. A process for treating radioactive waste in the form of contaminated, powdery ion exchange resin, which comprises:

a) mechanically dewatering the ion exchange resin;

b) mixing the dewatered ion exchange resin with a calcium compound to form a mixture;

c) drying the mixture at temperatures of up to 120° C. and at a pressure of from 120 to 200 hPa, until a residual moisture content of less than 10% of the mass of the mixture is reached; and d) thermally treating the dry mixture at a pressure below atmospheric pressure by heating up to a temperature of from at least 120° C. to at most 190° C.

2. The process according to claim 1, which comprises carrying out the step of drying the mixture at temperatures of 50° C. to 60° C.

3. The process according to claim 1, which comprises introducing the thermally treated mixture into a matrix after the mixture has cooled.

4. The process according to claim 3, which comprises selecting cement or bitumen as the matrix, and adjusting the mass of the mixture to amount to up to 50% of the mass of the matrix.

5. The process according to claim 1, which comprises selecting calcium hydroxide ($Ca(OH)_2$) as the calcium compound in an amount accounting for 50% to 150% of the take-up capacity of the ion exchange resins.

6. The process according to claim 1, which comprises passing on vapors drawn off during drying and during the thermal treatment to a waste water treatment after their condensation, in the same way as water occurring during the dewatering.

7. The process according to claim 1, which comprises performing at least the mixing, drying and thermal treatment of the ion exchange resin and the calcium compound in a mixing device remaining in operation at least until completion of the thermal treatment.

* * * * *